US009609727B2

(12) United States Patent
Chen et al.

(10) Patent No.: US 9,609,727 B2
(45) Date of Patent: Mar. 28, 2017

(54) LIGHTING DEVICE AND LIGHTING CONTROL SYSTEM HAVING THE SAME

(71) Applicant: HEP TECH CO., LTD., Taichung (TW)

(72) Inventors: Po-Yen Chen, Taichung (TW); Ta-Sheng Hung, Taichung (TW)

(73) Assignee: HEP TECH CO., LTD., Taichung (TW)

( * ) Notice: Subject to any disclaimer, the term of this patent is extended or adjusted under 35 U.S.C. 154(b) by 0 days.

(21) Appl. No.: 14/922,537

(22) Filed: Oct. 26, 2015

(65) Prior Publication Data

US 2016/0143119 A1 May 19, 2016

(30) Foreign Application Priority Data

Nov. 14, 2014 (TW) ..... 103139619 A

(51) Int. Cl.
*H05B 37/02* (2006.01)

(52) U.S. Cl.
CPC ..... *H05B 37/0272* (2013.01); *H05B 37/0254* (2013.01)

(58) Field of Classification Search
None
See application file for complete search history.

(56) References Cited

U.S. PATENT DOCUMENTS

| | | | | |
|---|---|---|---|---|
| 8,110,996 | B2 | 2/2012 | Budike, Jr. | |
| 2012/0043900 | A1* | 2/2012 | Chitta | H05B 41/295 315/201 |
| 2013/0229112 | A1* | 9/2013 | Van Der Werff | H05B 37/0245 315/151 |
| 2014/0265919 | A1* | 9/2014 | Pope | G06F 8/665 315/294 |
| 2015/0054423 | A1* | 2/2015 | Tyson | H05B 37/0272 315/291 |

* cited by examiner

*Primary Examiner* — Douglas W Owens
*Assistant Examiner* — James H Cho
(74) *Attorney, Agent, or Firm* — WPAT, PC; Justin King

(57) ABSTRACT

A lighting device is provided, which may include a power converting module, a lighting module, a wireless receiving module and a wired receiving module. The power converting module may be coupled to the lighting module, the wireless receiving module and the wired receiving module. The wireless receiving module may receive a second control signal transmitted from a wireless control module by a wireless transmission technology, and convert the second control signal into a second converted control signal. The wired receiving module may receive a first control signal transmitted from a wired control module, and convert the first control signal into a first converted control signal. The power converting module may drive the lighting module and the wireless receiving module, and may adjust the luminous status of the lighting module according to the first and second converted control signals.

20 Claims, 6 Drawing Sheets

LIGHTING DEVICE AND LIGHTING CONTROL SYSTEM HAVING THE SAME

CROSS REFERENCE TO RELATED APPLICATION

This application also claims priority to Taiwan Patent Application No. 103139619 filed in the Taiwan Patent Office on Nov. 14, 2014, the entire content of which is incorporated herein by reference.

TECHNICAL FIELD

The present disclosure relates to a lighting device, in particular to a wired/wireless lighting device capable of receiving control signals by wired transmission and wireless transmission to control the luminous status of the lighting device. The present disclosure further relates to a lighting control system having the lighting device.

BACKGROUND

Generally speaking, the lighting devices of most of office buildings, factories and dwelling houses are controlled by a wired lighting control system; in other words, the lighting devices are usually controlled by the lighting switches installed on the wall. Thus, if the user wants to turn on or turn off the lighting device at a specific position, or adjusts its brightness, the user only needs to walk to the switch corresponding to the lighting device and then the user can operate the lighting device. Therefore, the wired lighting control system can help the user conveniently operate the lighting device; however, if there are many lighting devices distributed at different positions over a large area, the user cannot operate all of these lighting devices in a short time; in this case, the wired lighting control system is not very convenient for the user.

As a result, the wireless lighting control system was developed so as to solve the above problem. For example, U.S. Pat. No. 8,110,996 disclosed a modular wireless lighting control system, which uses a central computer to transmit control signals to multiple transceivers via wireless network so as to control all lighting devices inside a building. Although the wireless lighting control system does not need complicated wiring and can control a large number of lighting devices in a short time. However, as the wireless lighting control system needs to transmit control signals via the wireless network, but the wireless network is not always stable; therefore, once the wireless network is disconnected, the user absolutely cannot control these lighting devices. Thus, the reliability of the wireless lighting control system still needs to be improved.

In addition, the practicality of the wireless lighting control system is still in dispute. For example, in general, after a user returns to home from work, the user will directly turn on the lighting devices by the switches installed on the wall; under above circumstance, it will be very inconvenient for the user to use a mobile phone, a computer or other wireless control devices to control the lighting devices in the house. On the contrary, when the user is going to sleep, the user will usually use a wireless control device to turn off all lighting devices in the house at a time. For the reason, the house only having the wireless lighting control system cannot conform to the habits of most users without further improvements. As described above, the wired lighting control system and the wireless lighting control system have their advantages, but they still have shortcomings which need to be overcome.

Accordingly, it has become an important issue to provide a lighting control system and the corresponding lighting device capable of not only achieving the advantages of both of the wired lighting control system and the wireless lighting control system, but also improving their shortcomings.

SUMMARY

The present disclosure is related to a lighting device. In one embodiment of the disclosure, the lighting device which may include a power converting module, a lighting module, a wireless receiving module and a wired receiving module. The power converting module may receive a power input signal. The wireless receiving module may be detachably coupled to the power converting module, wherein the wireless receiving module may receive a second control signal transmitted from a wireless control module by a wireless transmission technology, and convert the second control signal into a second converted control signal, and transmit the second converted control signal to the power converting module. The wired receiving module may be coupled to the power converting module, wherein the wired receiving module may receive a first control signal transmitted from a wired control module, and convert the first control signal into a first converted control signal, and transmit the first converted control signal to the power converting module. The power converting module may drive the lighting module and the wireless receiving module by the power input signal, and adjust the luminous status of the lighting module according to the first converting control signal and the second converted control signal.

The present disclosure is further related to a lighting control system. In another embodiment of the disclosure, the lighting control system may include a lighting device, a wired control module and a wireless control module. The lighting device may include a power converting module, a lighting module, a wireless receiving module, and a wired receiving module, wherein the power converting module may receive a power input signal, and may be coupled to the lighting module, the wireless receiving module, and the wired receiving module. The wired control module may be coupled to the wired receiving module, wherein the wired control module may transmit a first control signal to the wired receiving module; the wired receiving module may convert the first control signal into a first converted control signal and transmit the first converted control signal to the power converting module. The wireless control module may be operable to transmit a second control signal by a wireless transmission technology, wherein the wireless receiving module may receive the second control signal and convert the second control signal into a second converted control signal, and transmit the second converted control signal to the power converting module. The power converting module may drive the lighting module and the wireless receiving module by the power input signal, and adjust the luminous status of the lighting module according to the first converted control signal and the second converted control signals.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
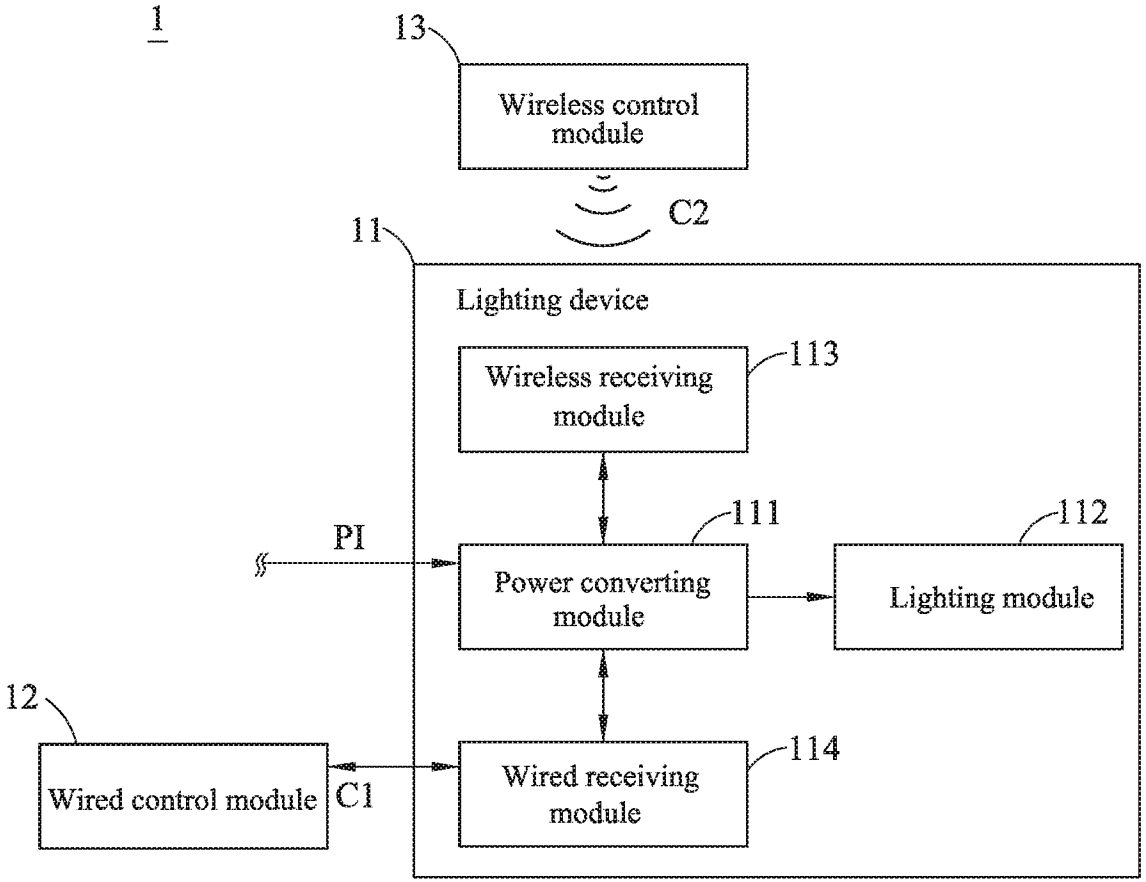
FIG. 1 is the block diagram of the lighting control system in accordance with the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Please refer to FIG. 1, which is the block diagram of the lighting control system in accordance with the present invention. As shown in FIG. 1, the lighting control system 1 may include a lighting device 11, a wired control module 12 and a wireless control module 13; the lighting device 11 may include a power converting module 111, a lighting module 112, a wireless receiving module 113 and a wired receiving module 114.

The power converting module 111 may be coupled to the lighting module 112, the wireless receiving module 113 and the wired receiving module 114. In the meanwhile, the power converting module 111 may be coupled to a power supply to receive the power input signal PI from the power supply so as to supply power to the lighting module 112, the wireless receiving module 113, and the wired receiving module 114. The wired receiving module 114 may receive a first control signal C1 transmitted from the wired control module 12, and convert the first control signal C1 into a first converted control signal which can be read by the power converting module 111; then, the wired receiving module 114 may transmit the first converted control signal to the power converting module 111. The wireless control module 13 may transmit a second control signal C2 via various wireless transmission technologies; the wireless receiving module 113 may receive the second control signal C2 and convert the second control signal C2 into a second converted control signal which can be read by the power converting module 111; then, the wireless receiving module 114 may transmit the second converted control signal to the power converting module 111. Preferably, the aforementioned wireless transmission technologies may include infrared, laser, Bluetooth, ZigBee, Wi-Fi, and the like.

Therefore, the user can wiredly transmit the first control signal C1 to the wired receiving module 114 via the wired control module 12, and convert the first control signal C1 into the first converted control signal which can be read by the power converting module 111; then, the first converted control signal can be transmitted to the power converting module 111 so as to control the lighting module 112 via the power converting module 111. In the meanwhile, the user also can wirelessly transmit the second control signal C2 to the wireless receiving module 113 via the wireless control module 13, and convert the second control signal C2 into the second converted control signal which can be read by the power converting module 111; then, the second converted control signal can be transmitted to the power converting module 111 so as to control the lighting module 112 via the power converting module 111. As described above, the user can select whether to use the wired control module 12 or the wireless control module 13 to wiredly or wirelessly turn on, turn off, adjust the brightness of the lighting module 112, or perform other operations.

Figure 2:
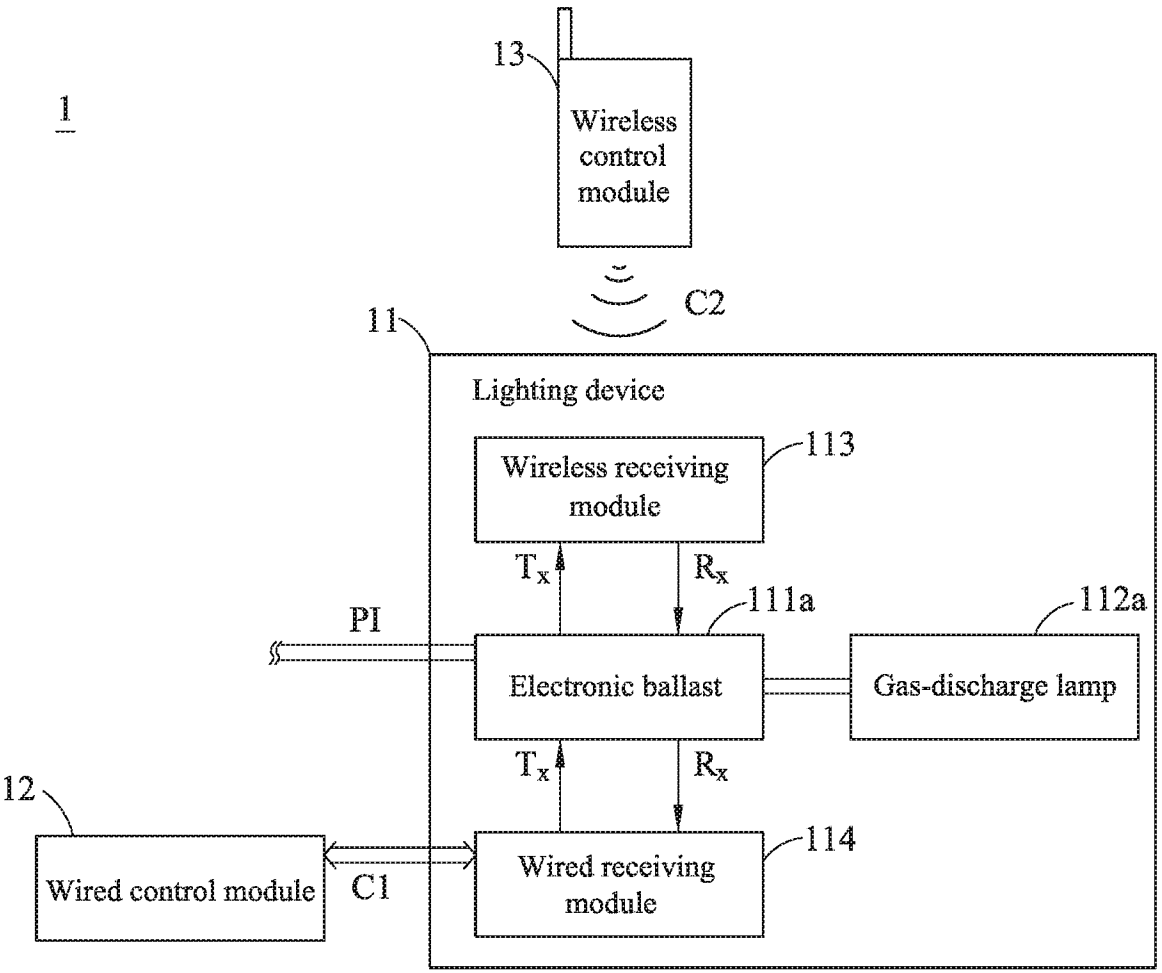
FIG. 2 is the schematic view of the first embodiment of the lighting control system in accordance with the present invention.

Please refer to FIG. 2, which is the schematic view of the first embodiment of the lighting control system in accordance with the present invention. As shown in FIG. 2, the lighting control system 1 may include a lighting device 11, a wired control module 12 and a wireless control module 13; the lighting device 11 may include a power converting module, a lighting module, a wireless receiving module 113 and a wired receiving module 114. The differences between the embodiment and the previous embodiment are that the power converting module of the embodiment may be an electrical ballast 111*a*, and the lighting module may be a gas-discharge lamp 112*a*.

The electrical ballast 111*a* may be coupled to the gas-discharge 112*a*, the wireless receiving module 113 and the wired receiving module 114. More specifically, the wireless receiving module 113 may be detachably coupled to the electrical ballast 111*a* by a connector; the connector may be, for example, a USB (Universal Serial Bus) interface. Besides, the gas-discharge lamp may be, for example, a mercury lamp, a metal halide lamp, a sodium lamp, a fluorescent lamp, or a xenon lamp. However, the above description is just for example instead of limitation; the present invention will not be limited by the above description.

The electrical ballast 111*a* may be coupled to a power supply to receive the power input signal PI from the power supply so as to supply power to the gas-discharge lamp 112*a*, the wireless receiving module 113, and the wired receiving module 114. The wired receiving module 114 may receive a first control signal C1 transmitted from the wired control module 12, and convert the first control signal C1 into a first converted control signal which can be read by the electrical ballast 111*a*; then, the wired receiving module 114 may transmit the first converted control signal to the electrical ballast 111*a*. The wireless control module 13 may transmit a second control signal C2 via various wireless transmission technologies; the wireless receiving module 113 may receive the second control signal C2 and convert the second control signal C2 into a second converted control signal which can be read by the electrical ballast 111*a*; then, the wireless receiving module 113 may transmit the second converted control signal to the electrical ballast 111*a*.

Similarly, the user can wiredly transmit the first control signal C1 to the wired receiving module 114 via the wired control module 12 (e.g. the switch on the wall), and convert the first control signal C1 into the first converted control signal which can be read by the electrical ballast 111*a*; then, the first converted control signal can be transmitted to the electrical ballast 111*a* so as to control the gas-discharge lamp 112*a* via the electrical ballast 111*a*. In the meanwhile, the user also can wirelessly transmit the second control signal C2 to the wireless receiving module 113 via the wireless control module 13 (e.g. cell phone, notebook computer or tablet computer), and convert the second control signal C2 into the second converted control signal which can be read by the electrical ballast 111*a*; then, the second converted control signal can be transmitted to the electrical ballast 111*a* so as to control the gas-discharge 112*a* via the electrical ballast 111*a*. By means of the above design, the user can select whether to use the wired control module 12 or the wireless control module 13 to wiredly or wirelessly turn on, turn off, adjust the brightness of the gas-discharge lamp 112*a*, or perform other operations.

Figure 3:
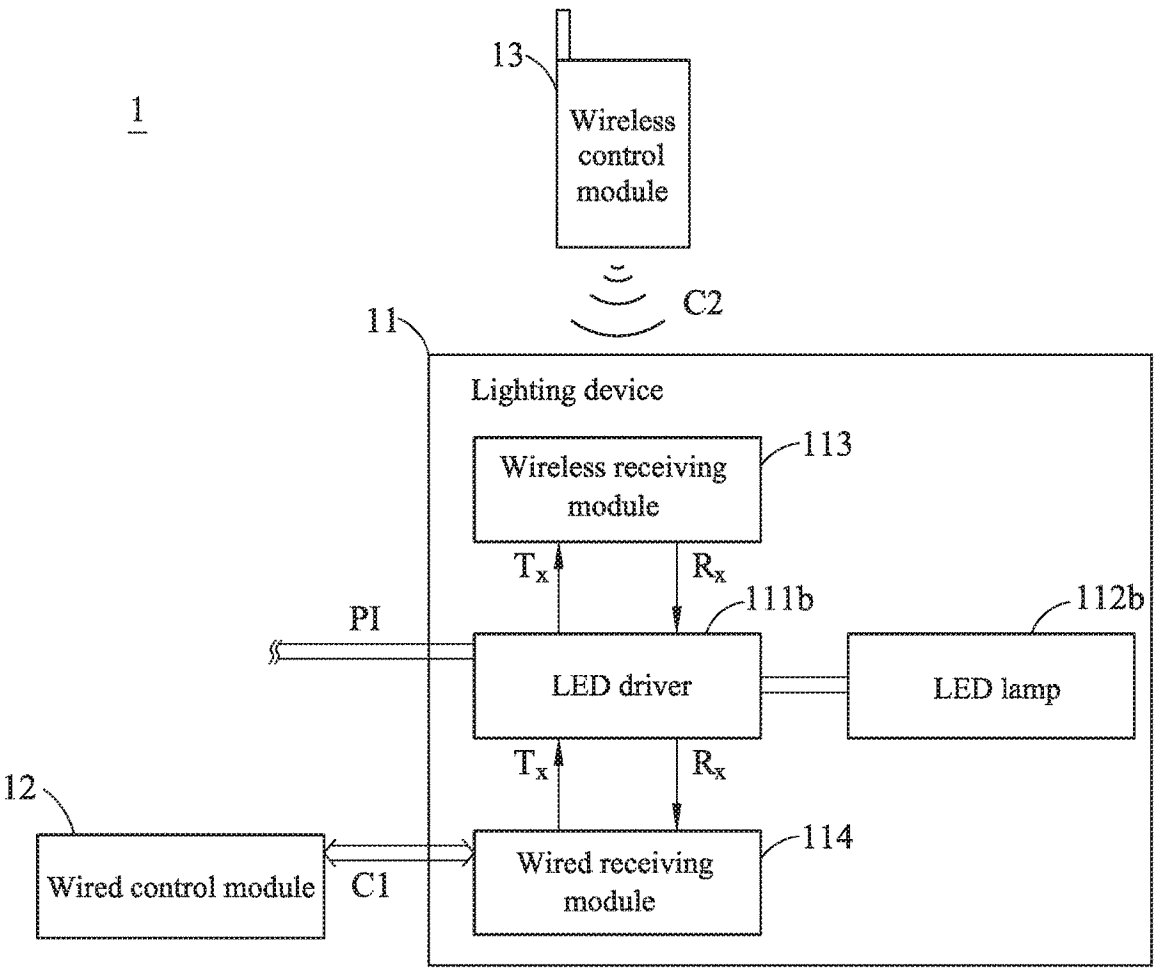
FIG. 3 is the schematic view of the second embodiment of the lighting control system in accordance with the present invention.

Please refer to FIG. 3, which is the schematic view of the second embodiment of the lighting control system in accordance with the present invention. As shown in FIG. 3, the lighting control system 1 may include a lighting device 11, a wired control module 12 and a wireless control module 13; the lighting device 11 may include a power converting module, a lighting module, a wireless receiving module 113 and a wired receiving module 114. The differences between the embodiment and the previous embodiment are that the power converting module of the embodiment may be a LED driver 111*b*, and the lighting module may be a LED lamp 112*b*.

The LED driver 111*b* may be coupled to the LED lamp 112*b*, the wireless receiving module 113 and the wired receiving module 114. Similarly, the wireless receiving module 113 may be detachably coupled to the LED driver 111*b* by a connector.

The LED driver 111*b* may be coupled to a power supply to receive the power input signal PI from the power supply so as to supply power to the LED lamp 112*b*, the wireless receiving module 113, and the wired receiving module 114. The wired receiving module 114 may receive a first control signal C1 transmitted from the wired control module 12, and convert the first control signal C1 into a first converted control signal which can be read by the LED driver 111*b*; then, the wired receiving module 114 may transmit the first converted control signal to the LED driver 111*b*. The wireless control module 13 may transmit a second control signal C2 via various wireless transmission technologies; the wireless receiving module 113 may receive the second control signal C2 and convert the second control signal C2 into a second converted control signal which can be read by the LED driver 111*b*; then, the wireless receiving module 113 may transmit the second converted control signal to the LED driver 111*b*. Thus, the user can select whether to use the wired control module 12 or the wireless control module 13 to wiredly or wirelessly turn on, turn off, adjust the brightness of the LED lamp 112*b*, or perform other operations.

As described above, the design of the lighting device according to present invention can not only be applied to gas-discharge lamp, but also can be applied to LED lamp, or other kinds of lighting modules. Therefore, the application of the lighting device according to the present invention can be very comprehensive.

It is worthy to point out that the conventional wired lighting control system can only allow the user to manually operate the switches on the wall to control the lighting devices; therefore, if there are many lighting devices in the building, it is impossible for the user to swiftly and efficiently control these lighting devices. In addition, the conventional wireless lighting control system allows the user to swiftly and efficiently control many lighting devices; however, the conventional wireless lighting control system cannot conform to the habits of most users, so its practicality is still in dispute. On the contrary, the lighting control system according to the embodiments of the present invention can effectively integrate the wireless lighting control system and the wired lighting control system via special design, so the user can choose whether to wiredly or wirelessly control the lighting devices according to actual requirements. For example, after the user returns to home from work, the user can directly turn on the lighting devices by the switches installed on the wall; when the user is going to sleep, the user can directly use his cell phone to turn off all lighting devices in the house at a time. As described above, the lighting control system according to the embodiments of the present invention can not only swiftly and efficiently control a lot of lighting devices, but also can conform to the habits of most users under certain circumstances. Thus, the lighting control system according to the embodiments of the present invention can achieve higher practicality.

Also, the wireless network of the conventional wireless lighting control system is unstable; therefore, once the wireless network is disconnected, the user absolutely cannot control the lighting devices; therefore, the conventional wireless lighting control system cannot achieve high reliability. On the contrary, the lighting control system according to the embodiments of the present invention can have the functions of both of the wired lighting control system and the wireless lighting control system, so the user can still wiredly control the lighting devices even if the wireless network is unstable. Accordingly, the lighting control system according to the embodiments of the present invention can achieve higher reliability.

In addition, the wireless receiving module of the lighting device according to the embodiments of the present invention can be detachably coupled to the power converting module via a connector. Therefore, the wireless receiving module and the lighting device can be different products for sales, and the user also can determine whether to purchase the wireless receiving module or not according to his requirements. Thus, the lighting device according to the embodiments of the present invention can be more flexible in use and of high commercial value. As described above, the present invention definitely has an inventive step.

Figure 4:
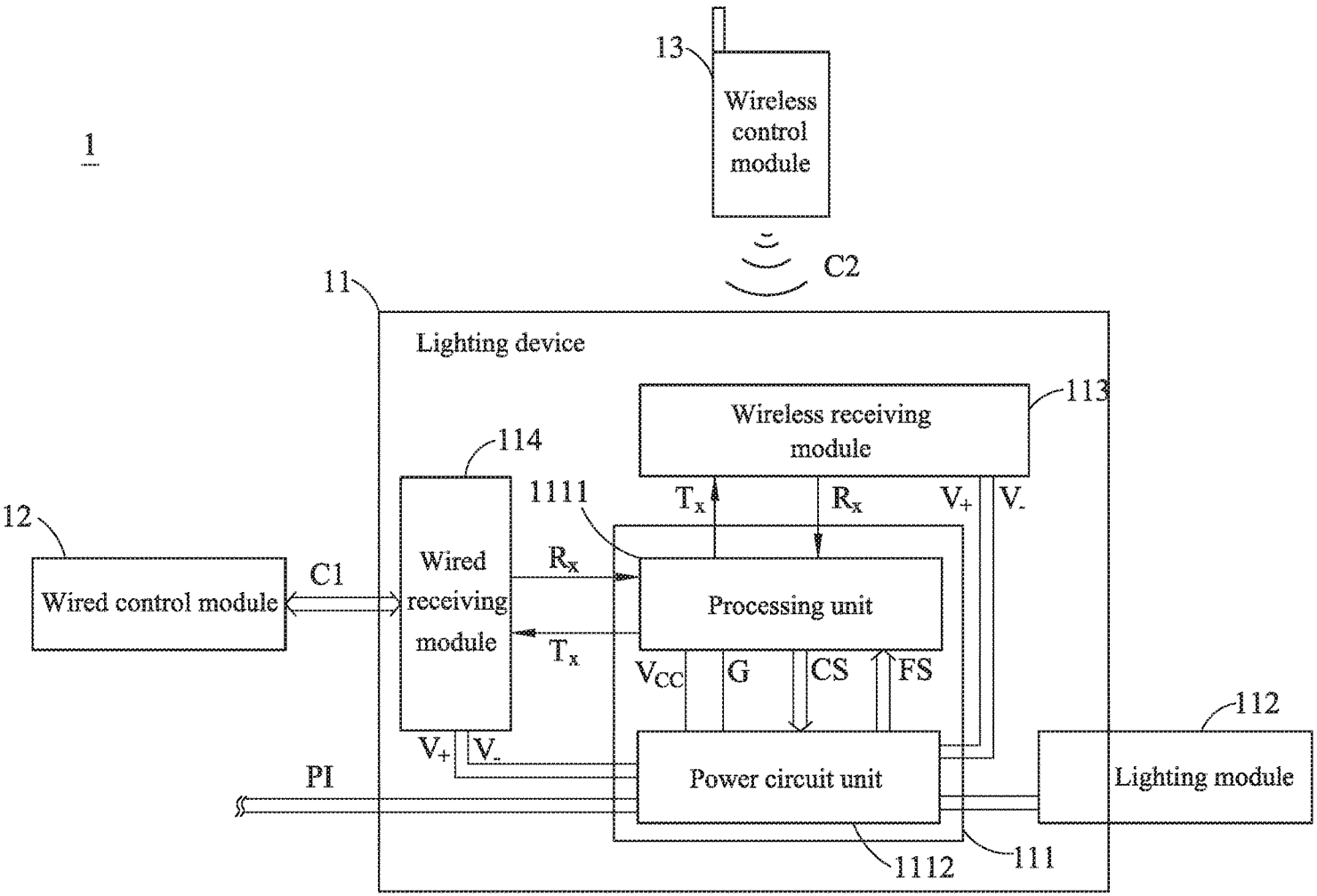
FIG. 4 is the schematic view of the third embodiment of the lighting control system in accordance with the present invention.

Please refer to FIG. 4, which is the schematic view of the third embodiment of the lighting control system in accordance with the present invention. As shown in FIG. 4, the lighting control system 1 may include a lighting device 11, a wired control module 12 and a wireless control module 13; the lighting device 11 may include a power converting module 111, a lighting module 112, a wireless receiving module 113 and a wired receiving module 114. The embodiment illustrates one of the preferred designs of the power converting module 111, the power converting module 111 may include a processing unit 1111 and a power circuit unit 1112. The processing unit 1111 may be a microcontroller (MCU) and the like.

The power circuit unit 1112 of the power converting module 111 may be coupled to a power supply to receive the power input signal PI from the power supply in order to supply power to the lighting module 112, the wireless receiving module 113, and the wired receiving module 114. The wired receiving module 114 may receive a first control signal C1 transmitted from the wired control module 12, and convert the first control signal C1 into a first converted control signal which can be read by the processing unit 1111; then, the wired receiving module 114 may transmit the first converted control signal to the processing unit 1111. The wireless control module 13 may transmit a second control signal C2 via various wireless transmission technologies; the wireless receiving module 113 may receive the second control signal C2 and convert the second control signal C2 into a second converted control signal which can be read by the processing unit 1111; then, the wireless receiving module 114 may transmit the second converted control signal to the power converting module 111. Afterward, the processing unit 1111 may transit a control signal CS to the power circuit unit 1112, and then the power circuit unit 1112 may transmit a feedback signal to the processing unit 1111; in this way, the processing unit 1111 may control the lighting module 112 via the power circuit unit 1112 according to the first control signal C1 and the second control signal C2.

Therefore, the user can wiredly transmit the first control signal C1 to the wired receiving module 114 via the wired control module 12, and convert the first control signal C1 into the first converted control signal which can be read by the processing unit 1111; then, the first converted control signal can be transmitted to the processing unit 1111 so as to control the lighting module 112. Alternatively, the user also can wirelessly transmit the second control signal C2 to the wireless receiving module 113 via the wireless control module 13, and convert the second control signal C2 into the second converted control signal which can be read by the processing unit 1111; then, the second converted control signal can be transmitted to the processing unit 1111 so as to control the lighting module 112.

Figure 5A:
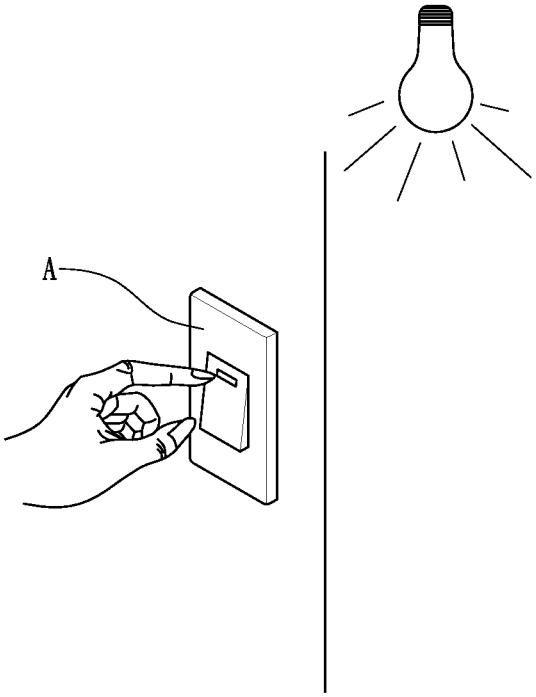
FIG. 5A is the first schematic view of the fourth embodiment of the lighting control system in accordance with the present invention.
Figure 5B:
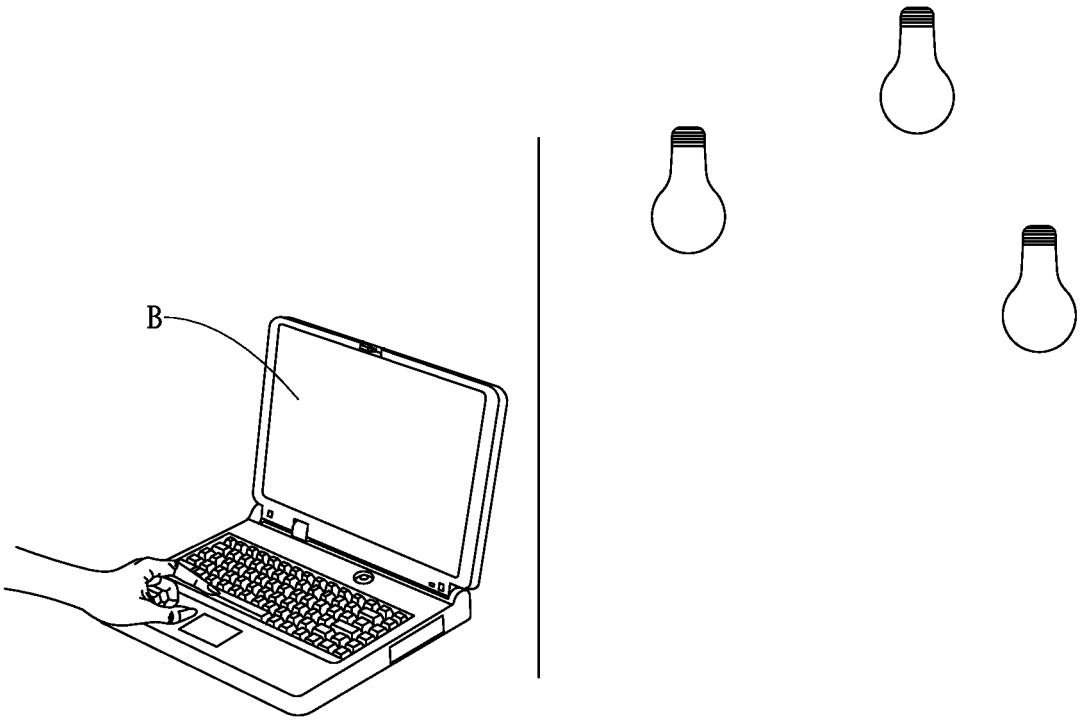
FIG. 5B is the second schematic view of the fourth embodiment of the lighting control system in accordance with the present invention.

Please refer to FIG. 5A and FIG. 5B, which are the first schematic view and the second schematic view of the fourth embodiment of the lighting control system in accordance with the present invention. The embodiment illustrates one of the usage situations of the lighting control system in accordance with the present invention. As shown in FIG. 5A, after the user returns to home from work, the user can directly press the switch A installed on the wall to wiredly turn the lighting device in the house. As shown in FIG. 5B, when the user is going to sleep, the user can directly use his notebook computer B to wirelessly turn off all lighting devices in the house at a time. As described above, the lighting control system according to the embodiment of the present invention can not only remain the advantages of both of the wireless lighting control system and the wired lighting control system, but also can improve the shortcomings of both of the wireless lighting control system and the wired lighting control system. For the reason, the lighting control system according to the embodiment of the present invention can conform to the habits of most users and achieve higher practicality.

In summation of the description above, the lighting device and the lighting control system having the same in accordance with the embodiments of the present invention may have the following advantages:

(1) According to one embodiment of the present invention, the lighting control system adopts special design to integrate the wired lighting system with the wireless lighting system, so the user can select whether to wiredly control or wirelessly control the lighting devices according to actual requirements, which can conform to the habits of most users. Accordingly, the lighting control system according to the embodiments of the present invention can achieve higher practicality.

(2) According to one embodiment of the present invention, the lighting control system may have the functions of both of the wired lighting control system and the wireless lighting control system; therefore, once the wireless network is unstable, the user still can wiredly control the lighting devices. Accordingly, the lighting control system according to the embodiments of the present invention can achieve high reliability.

(3) According to one embodiment of the present invention, the wireless lighting control system and the wired lighting control system can be effectively integrated with each other via a special circuit design, which can not only remain the advantages of both of the wireless lighting control system and the wired lighting control system, but also can improve the shortcomings of both of the wireless lighting control system and the wired lighting control system. Accordingly, the lighting control system according to the embodiments of the present invention can be more convenient in use.

(4) According to one embodiment of the present invention, the wireless receiving module can be detachably coupled to the power converting module, so the wireless receiving module and the lighting device can be different products for sales, and the user also can determine whether to purchase the wireless receiving module or not according to his requirements. Thus, the lighting device according to the embodiments of the present invention can be more flexible in use and of high commercial value.

(5) According to one embodiment of the present invention, the design of the lighting device can not only be applied to gas-discharge lamp, but also can be applied to LED lamp or other lighting devices. Accordingly, the application of the lighting device according to the embodiments of the present invention is very comprehensive.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A lighting device, comprising:

a power converting module, operable to receive a power input signal, and comprising a processing unit and a power circuit unit;

a lighting module, coupled to the power circuit unit;

a wireless receiving module, detachably coupled to the processing unit and the power circuit unit via a connector, wherein the wireless receiving module receives a second control signal transmitted from a wireless control module by a wireless transmission technology, and converts the second control signal into a second converted control signal, and transmits the second converted control signal to the power converting module; and a wired receiving module, coupled to the processing unit and the power circuit unit, wherein the wired receiving module receives a first control signal transmitted from a wired control module, and converts the first control signal into a first converted control signal, and transmits the first converted control signal to the power converting module;

wherein the power converting module drives the lighting module and the wireless receiving module by the power input signal, and adjusts a luminous status of the lighting module according to the first converting control signal and the second converted control signal.

2. The lighting device of claim 1, wherein the lighting module is a gas-discharge lamp.

3. The lighting device of claim 2, wherein the power converting module is an electrical ballast.

4. The lighting device of claim 2, wherein the gas-discharge lamp is a mercury lamp, a metal halide lamp, a sodium lamp, a fluorescent lamp, or a xenon lamp.

5. The lighting device of claim 1, wherein the lighting module is a LED lamp.

6. The lighting device of claim 5, wherein power converting module is a LED driver.

7. The lighting device of claim 1, wherein the power circuit unit receives the power input signal to drive the processing unit, the lighting module, and the wireless receiving module; the processing unit receives the first converted control signal and the second converted control signal, and then adjusts the luminous status of the lighting module by the power circuit unit according to the first converted control signal and the second converted control signal.

8. The lighting device of claim 7, wherein the processing unit is a microcontroller.

9. The lighting device of claim 1, wherein the connector is a USB interface.

10. The lighting device of claim 1, wherein the wireless transmission technology is an infrared, a laser, a Bluetooth, a ZigBee and a Wi-Fi.

11. A lighting control system, comprising:

a lighting device, comprising a power converting module, a lighting module, a wireless receiving module, and a wired receiving module, wherein the power converting module receives a power input signal, wherein the power converting module comprises a processing unit and a power circuit unit; the wireless receiving module is detachably coupled to the processing unit and the power circuit unit via a connector; the wired receiving module is coupled to the processing unit and the power circuit unit; the lighting module is coupled to the power circuit unit;

a wired control module, coupled to the wired receiving module, wherein the wired control module transmits a first control signal to the wired receiving module; the wired receiving module converts the first control signal into a first converted control signal and transmits the first converted control signal to the power converting module; and a wireless control module, operable to transmit a second control signal by a wireless transmission technology, wherein the wireless receiving module receives the second control signal and converts the second control signal into a second converted control signal, and transmits the second converted control signal to the power converting module;

wherein the power converting module drives the lighting module and the wireless receiving module by the power input signal, and adjusts a luminous status of the lighting module according to the first converted control signal and the second converted control signals.

12. The lighting control system of claim 11, wherein the lighting module is a gas-discharge lamp.

13. The lighting control system of claim 12, wherein the power converting module is an electrical ballast.

14. The lighting control system of claim 12, wherein the gas-discharge lamp is a mercury lamp, a metal halide lamp, a sodium lamp, a fluorescent lamp, or a xenon lamp.

15. The lighting control system of claim 11, wherein the lighting module is a LED lamp.

16. The lighting control system of claim 15, wherein power converting module is a LED driver.

17. The lighting control system of claim 11, wherein the power circuit unit receives the power input signal to drive the processing unit, the lighting module, and the wireless receiving module; the processing unit receives the first converted control signal and the second converted control signal, and then adjusts the luminous status of the lighting module by the power circuit unit according to the first converted control signal and the second converted control signal.

18. The lighting control system of claim 17, wherein the processing unit is a microcontroller.

19. The lighting control system of claim 11, wherein the connector is a USB interface.

20. The lighting control system of claim 11, wherein the wireless transmission technology is an infrared, a laser, a Bluetooth, a ZigBee and a Wi-Fi.

* * * * *